US006401980B2

(12) United States Patent
Iggulden

(10) Patent No.: US 6,401,980 B2
(45) Date of Patent: Jun. 11, 2002

(54) DEVICE FOR COLLECTING AND ABSORBING DRIPS ON A FLUID CONTAINER

(76) Inventor: Jerry Iggulden, 10345 W. Olympic Blvd., Los Angeles, CA (US) 90064

( * ) Notice: Subject to any disclaimer, the term of this patent is extended or adjusted under 35 U.S.C. 154(b) by 0 days.

(21) Appl. No.: 09/808,526

(22) Filed: Mar. 13, 2001

Related U.S. Application Data

(63) Continuation-in-part of application No. 09/549,905, filed on Apr. 14, 2000.

(51) Int. Cl.[7] ..... B65D 23/06

(52) U.S. Cl. ..... 222/108; 222/571; 428/41.7; 428/40.1; 428/42.3; 428/343; 428/906

(58) Field of Search ..... 222/108, 571; 220/695, 731; 215/251, 253, 258, 232, 41, 392, 394; 156/212; 428/42.2, 42.3, 41.7, 40.1, 906, 43, 343, 354

(56) References Cited

U.S. PATENT DOCUMENTS

| | | | | |
|---|---|---|---|---|
| 134,302 A | | 12/1872 | Miller | 215/392 |
| 447,635 A | | 3/1891 | Day, Jr. | 215/392 |
| 571,327 A | | 11/1896 | Hamilton | 215/392 |
| 657,327 A | | 9/1900 | Williams | 215/392 |
| 811,742 A | | 2/1906 | Petrie | 215/392 |
| 1,182,993 A | | 5/1916 | Deeks | 215/392 |
| 1,449,335 A | | 3/1923 | Latham | 215/392 |
| 1,683,176 A | | 9/1928 | Faulhaber | 215/392 |
| 2,105,027 A | | 1/1938 | Davis | 222/108 |
| 2,918,033 A | | 12/1959 | Snyder | 116/206 |
| 2,918,893 A | | 12/1959 | Norton | 116/206 |
| 3,063,590 A | | 11/1962 | Hopkins | 215/392 |
| 4,297,403 A | * | 10/1981 | Smith | 429/906 X |
| 4,437,583 A | | 3/1984 | O'Connor | 222/108 |
| 4,631,227 A | | 12/1986 | Nakamura | 428/343 X |
| 4,743,499 A | | 5/1988 | Volke | 428/343 X |
| 4,784,653 A | | 11/1988 | Bolton et al. | 428/354 X |
| 5,484,635 A | | 1/1996 | Andersen et al. | 222/108 X |
| 5,683,775 A | * | 11/1997 | Franklin | 428/40.1 |
| 5,824,379 A | * | 10/1998 | Riley et al. | 428/40.1 |

FOREIGN PATENT DOCUMENTS

| | | | |
|---|---|---|---|
| CH | 498 609 | | 11/1970 |
| CH | 550702A A | * | 6/1974 |
| DE | 896 014 | | 7/1949 |
| DE | 296 19 453 U1 | * | 4/1997 |
| EP | 581361 A1 | * | 2/1994 |
| FR | 1 427 978 | | 4/1966 |
| FR | 2606372 A1 | * | 5/1988 |
| FR | 2611659 A2 | * | 9/1988 |
| FR | 2614274 A1 | * | 10/1988 |
| FR | 2716867 A1 | * | 9/1995 |
| FR | 2 763 565 | | 11/1998 |
| GB | 2146610 A | * | 4/1985 |
| JP | 2-98550 A | * | 4/1990 |
| WO | WO-98/52831 A1 | * | 11/1998 |

* cited by examiner

*Primary Examiner*—Kenneth Bomberg
(74) *Attorney, Agent, or Firm*—Blakely, Sokoloff, Taylor & Zafman LLP

(57) ABSTRACT

In one embodiment, a device for collecting and absorbing drips on an exterior of a fluid container comprises an elongated strip of laminated construction. A material substantially impervious to the fluid in the container is adhesively bonded to a layer of absorbent material. A further layer of adhesive is applied to the other side of the absorbent material so that a strip of desired length may be secured to the exterior of the fluid container.

3 Claims, 2 Drawing Sheets

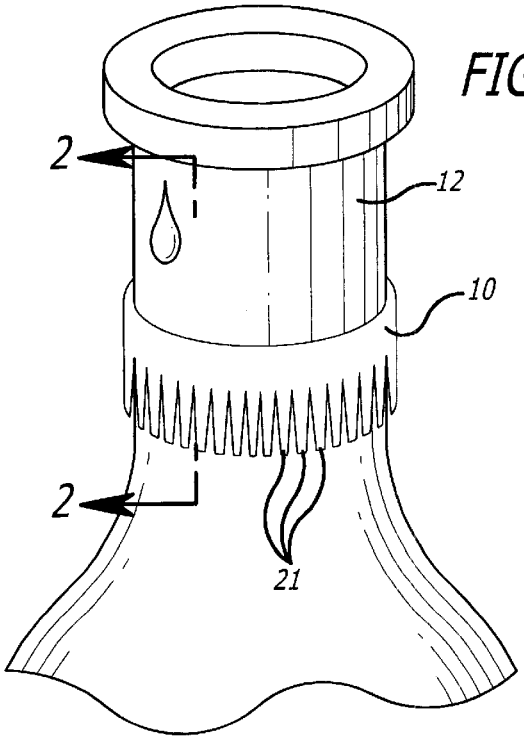
FIG. 1
FIG. 2
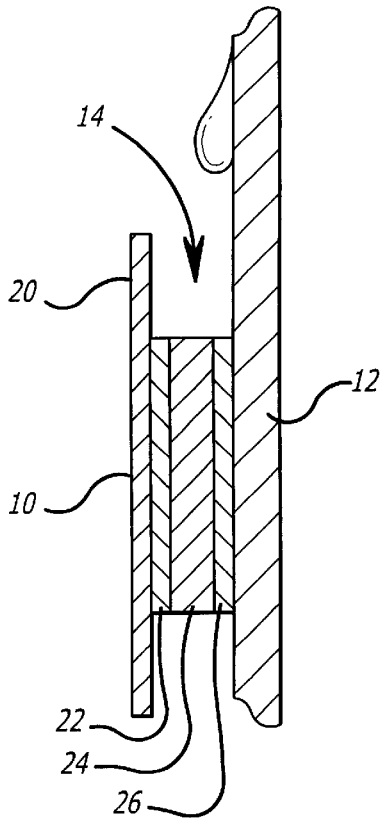
FIG. 4
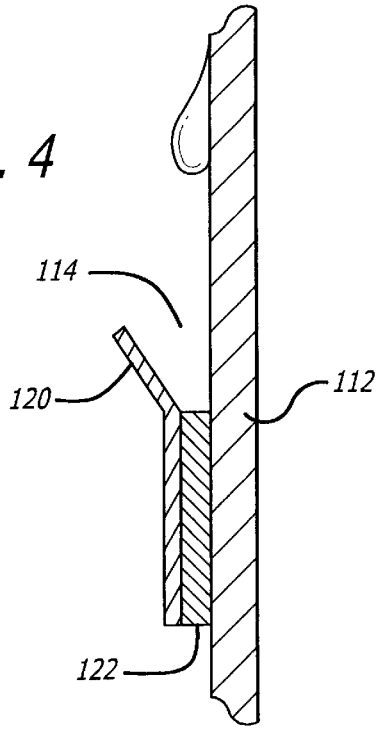

DEVICE FOR COLLECTING AND ABSORBING DRIPS ON A FLUID CONTAINER

RELATED APPLICATION

This is a continuation-in-part of co-pending application Ser. No. 09/549,905 filed Apr. 14, 2000.

BACKGROUND OF THE INVENTION

2. Field of the Invention

The present invention relates generally to the field of fluid containers and, more particularly, to a device for collecting and absorbing drips of fluid that run down the side of a container after fluid is dispensed therefrom.

2. Background

Fluid dripping down the side of a fluid container is a common everyday annoyance. Virtually all consumers have experienced the resulting stains and rings on hands, floors, shelves and tables and the inevitable unsightly container sides and illegible labels. A number of approaches have been taken to solve this problem. A common solution, frequently used in restaurants, is the use of a cloth to cradle a bottle as the contents are poured. The cloth collects any inadvertent drips and can be used to wipe the outside of the bottle before the bottle is placed on the table. This is a less than ideal solution, since the cloth then becomes stained and will likely need to be discarded. Another common solution is the use of a coaster. This is also less than ideal since drips deposited on the coaster may nevertheless find their way to the table surface.

A number of devices have been proposed for absorbing drips on the neck of a bottle. For example, U.S. Pat. No. 447,635 discloses an absorbent bottle collar made of a strip of blotting paper or the like, which is held in place around the neck of a bottle with a wire or other tie. U.S. Pat. No. 1,182,993 discloses a drip guard for a bottle comprising an absorbent elastic band. U.S. Pat. No. 3,063,590 discloses a drip arrester for a bottle in which an absorbent inner layer is laminated to a relatively non-absorbent outer layer. U.S. Pat. No. 4,437,583 discloses a dribble ring made of an absorbent foam having a plastic or rubber coating on the outer circumference and bottom of the ring. U.S. Pat. No. 5,484,635 discloses a drip catcher in the form of a waterproof pocket filled with an absorbent material that is adhesively secured to the outside of a fluid container.

SUMMARY OF THE INVENTION

The present invention represents an improvement over the drip-catching devices of the prior art. In one embodiment, a device for collecting and absorbing drips on an exterior of a fluid container comprises an elongated strip of laminated construction. A material substantially impervious to the fluid in the container is adhesively bonded to a layer of absorbent material. A further layer of adhesive is applied to the other side of the absorbent material so that a strip of a desired length may be secured to the exterior of the fluid container.

BRIEF DESCRIPTION OF THE DRAWINGS

FIG. 1 is a perspective view of a first embodiment of the present invention.

FIG. 2 is a cross-sectional view taken through line 2-2 of FIG. 1.

FIG. 4 is a cross-sectional view of an alternative embodiment of the invention.

DETAILED DESCRIPTION OF THE INVENTION

Figure 3:
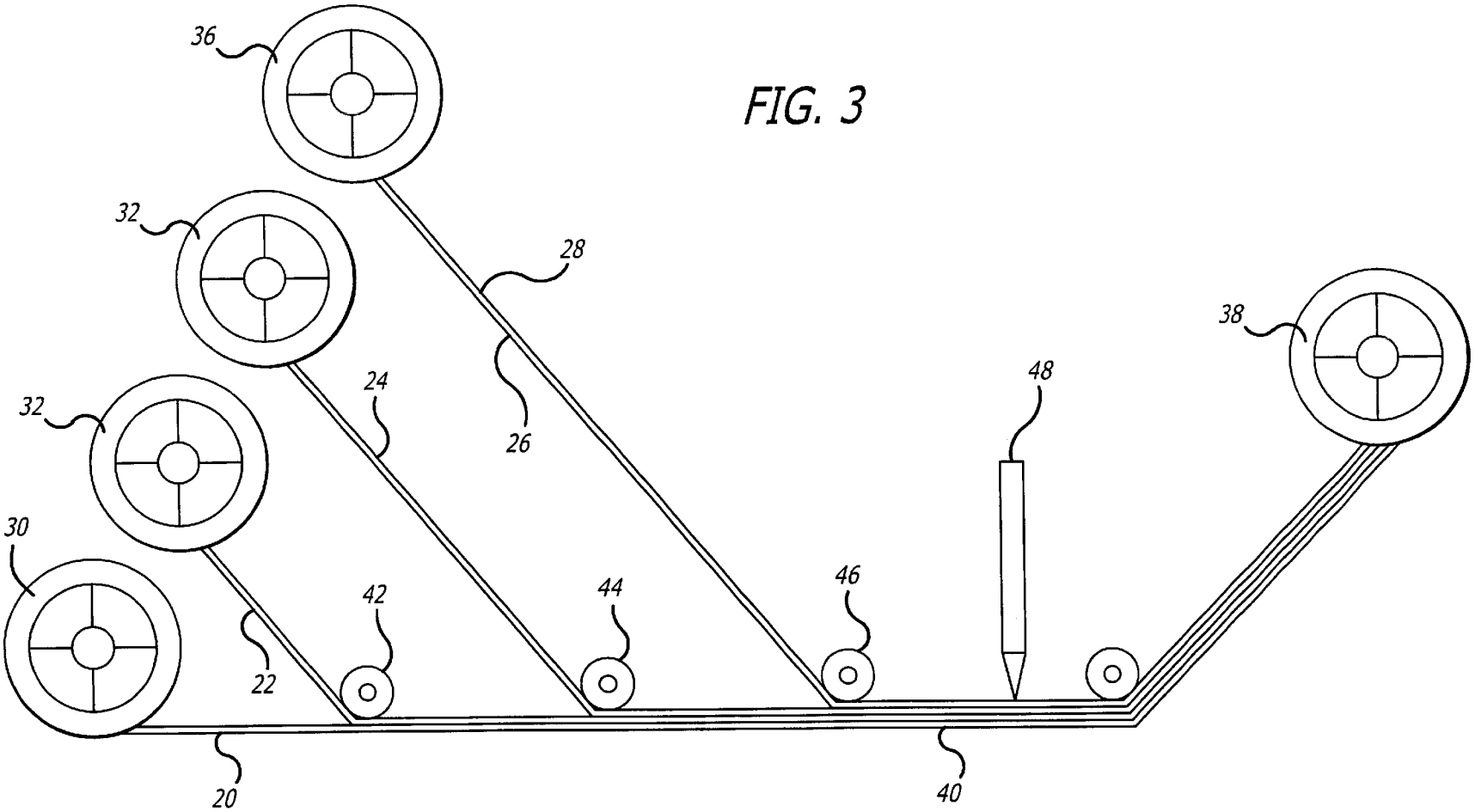
FIG. 3 illustrates a method for manufacturing the device shown in FIGS. 1 and 2.

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

FIG. 1 illustrates a first embodiment 10 of the present invention applied to the neck of a fluid container 12, such as a bottle of cooking oil. The invention is also applicable to containers for other fluids, including, for example, household products, such as glue, paint, oil, bleach, solvents, cleaners, etc. and kitchen products such as honey, catsup, vinegar, sauces, dressings, etc.

The layered construction of device 10 is illustrated in the cross-sectional view of FIG. 2. The outermost layer 20 comprises a thin, elongated strip of a material that is substantially impervious to the fluid in the container. For most applications, strip 20 may be made of a semi-rigid plastic material, such as Mylar® or the like. Strip 20 may have a plurality of slits or notches 21 along its lower edge so that it can conform to a container having a tapered neck. Next to strip 20 is a layer 22 of an adhesive material, such as a double-sided adhesive tape. Layer 24 comprises an absorbent material. A variety of materials may be used, depending upon the characteristics and volume of the fluid to be absorbed. For many applications, a paper material, such as commonly used for paper towels, tissues or blotters, may be used. Woven materials, such as felt or cotton gauze and open-cell foam materials may also be suitable. Layer 26 again comprises an adhesive, such as a double-sided adhesive tape.

Layers 22, 24 and 26 may be narrower than strip 20 so that a channel or gutter 14 is created along one or both edges of device 10 adjacent to the outer surface of fluid container 12. This aids in the collection of drips as they descend the side of container 12 and guides them to the layer of absorbent material 24. This is one reason why it is desirable to make strip 20 of a material that is substantially impervious to the fluid. Strip 20 also acts as a barrier for fluid collected in absorbent layer 24 so that an individual handling fluid container 12 will not be directly exposed to the collected fluid. The outer surface of strip 20 may be imprinted with a decorative design, a logotype or an advertising message.

FIG. 3 illustrates a method by which device 10 may be conveniently manufactured. Each layer is fed from a corresponding spool and laminated to make the final product. The material for layer 20 is fed from spool 30 and a double-sided adhesive tape for layer 22 is fed from spool 32. These are laminated under pressure roller 42. Next, the absorbent material for layer 24 is fed from spool 34 and laminated to adhesive layer 22 under pressure roller 44. Finally, a double-sided adhesive tape for layer 26 is fed from spool 36 and laminated to absorbent layer 24 under pressure roller 46. Adhesive layer 26 preferably includes a backing material 28 to protect the adhesive until device 10 is applied to a fluid container. After all the layers are laminated, the resulting strip 40 is wound onto spool 38. Guillotine chopper 48 cuts the laminated strip to the appropriate length. The laminated strip 40 is preferably packaged and sold in bulk lengths of, for example, 36 inches. The user then removes a piece 10 suitable for application to a container. Device 10 may completely encircle a container, as in the case of a bottle, or may be applied to only a portion of a container adjacent to a location from which the contents will be poured, as in the case of a paint can.

The laminated strip may be packaged in a dispenser having a cutting edge similar to dispensers commonly used for household tape products to facilitate removal of a desired length. Alternatively, the laminated strip may be scored or perforated at intervals, so that a desired length may be torn from the strip along one of the score lines or perforations. It is also contemplated that the laminated strip may be packaged in pre-cut lengths, which may be uniform or assorted.

The width of device 10 is not critical, provided that there is a sufficient quantity of absorbent material to absorb the amount of fluid that may be anticipated to drip down the fluid container. For most household applications, the width of device 10 is preferably in the range of approximately ⅜ inch to 1 inch. The preferred thickness of absorbent material 24 is likewise a function of the anticipated volume of absorbed fluid. However, it is important that the thickness be sufficient so that the gutter 14 will be large enough to receive a drip of fluid. If the gutter is too narrow (i.e., if absorbent layer 24 is too thin), drips will have a tendency to flow across the gutter and down the side of layer 20, thereby defeating the purpose of device 10.

In some applications, particularly for relatively viscous fluids such as paint, honey, syrup, etc., a layer of absorbent material 24 may not be necessary. A gutter 14 alone may be sufficient to collect drips of such viscous fluids. Fluid that collects in the gutter may then be removed with a sponge or towel. In such case, absorbent material 24 may be replaced with a non-absorbent material that simply serves to space strip 20 away from the surface of the fluid container. Alternatively, as shown in FIG. 4, a strip 120 may be curved or bent in cross section to create gutter 114. Here, only a single adhesive layer 122 is needed to adhere strip 120 to fluid container 112.

It will be recognized that the above- described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A combination of a fluid container containing a fluid and a device for collecting drips of the fluid on an exterior of the fluid container comprising:

a strip of a material substantially impervious to the fluid, said strip having a proximal edge proximate to an opening from which the fluid is dispensed;

an absorbent spacing material disposed between the strip and the fluid container so as to position at least the proximal edge of the strip in a spaced-apart relationship with the exterior of the container, said absorbent spacing material having a proximal edge displaced in a distal direction from the proximal edge of the strip so as to form a gutter in which drips of fluid are collected and absorbed into the absorbent spacing material.

2. The device of claim 1 wherein the strip encircles the container proximate to the opening.

3. The device of claim 1 wherein the device for collecting drips is secured to the container with an adhesive.

* * * * *